US008074648B2

(12) United States Patent
Betz et al.

(10) Patent No.: US 8,074,648 B2
(45) **Date of Patent: *Dec. 13, 2011**

(54) RESPIRATORY PROTECTION DEVICE

(75) Inventors: James R. Betz, Hudson, WI (US); Brandon H. Harmon, Murrieta, CA (US); Andrew S. Viner, Roseville, MN (US); Scott A. Larson, Oakdale, MN (US); David M. Castiglione, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 227 days.

This patent is subject to a terminal disclaimer.

(21) Appl. No.: 12/502,447

(22) Filed: Jul. 14, 2009

(65) Prior Publication Data

US 2009/0272378 A1 Nov. 5, 2009

Related U.S. Application Data

(63) Continuation of application No. 11/278,265, filed on Mar. 31, 2006, now Pat. No. 7,594,510.

(51) Int. Cl.
*A62B 23/02* (2006.01)

(52) U.S. Cl. ..... 128/205.27; 128/205.25

(58) Field of Classification Search ..... 128/200.28, 128/201.12, 201.14, 201.22, 201.23, 201.24, 128/202.27, 205.25, 857, 858, 206.24, 205.27, 128/206.12, 206.21; 2/410, 422, 424, 426, 2/427, 9, 206

See application file for complete search history.

(56) References Cited

U.S. PATENT DOCUMENTS

| | | | |
|---|---|---|---|
| 4,283,798 | A | 8/1981 | Kuehn |
| 4,648,394 | A | 3/1987 | Wise |
| 4,756,308 | A | 7/1988 | Ryback |
| 5,279,286 | A | 1/1994 | Chen |
| 5,575,278 | A | 11/1996 | Bonhomme et al. |
| 5,689,833 | A | 11/1997 | Allen et al. |
| 6,161,528 | A | 12/2000 | Akao et al. |
| 6,298,498 | B1 | 10/2001 | Burns et al. |
| 6,328,031 | B1 | 12/2001 | Tischer et al. |
| 6,382,208 | B2 | 5/2002 | Reedy et al. |
| 6,383,417 | B1 | 5/2002 | Paulson et al. |
| 6,412,487 | B1 | 7/2002 | Gunaratnam et al. |
| 6,520,177 | B1 | 2/2003 | Bonhomme et al. |
| 6,543,449 | B1 | 4/2003 | Woodring et al. |
| 6,619,286 | B2 | 9/2003 | Patel |
| 6,629,531 | B2 | 10/2003 | Gleason et al. |
| 6,651,662 | B2 | 11/2003 | Prete et al. |
| 6,675,800 | B2 | 1/2004 | Keller |
| 6,687,910 | B1 | 2/2004 | Smallwood |
| 6,895,960 | B2 | 5/2005 | Fabin |
| 6,896,308 | B2 | 5/2005 | Okanda et al. |
| 6,924,420 | B2 | 8/2005 | Rawal |

(Continued)

FOREIGN PATENT DOCUMENTS

| | | |
|---|---|---|
| WO | WO 98/13103 | 4/1998 |

(Continued)

OTHER PUBLICATIONS

Brochure for Survivair® Opti-Fit™ Tactical Gas Mask, commercially available prior to Mar. 31, 2006.

(Continued)

*Primary Examiner* — Steven Douglas

(57) ABSTRACT

A respiratory device includes a face seal and a unitary body that forms an interface with the face seal and includes a lens and a chassis. The chassis includes at least one port for fluidic connection.

14 Claims, 4 Drawing Sheets

U.S. PATENT DOCUMENTS

| | | | |
|---|---|---|---|
| 6,957,653 | B2 | 10/2005 | Campbell et al. |
| 7,261,104 | B2 | 8/2007 | Kiefer et al. |
| 2003/0047183 | A1 | 3/2003 | Kiefer et al. |
| 2007/0235031 | A1 | 10/2007 | Betz et al. |
| 2007/0235032 | A1 | 10/2007 | Betz et al. |
| 2007/0235033 | A1 | 10/2007 | Reier et al. |

FOREIGN PATENT DOCUMENTS

| | | | |
|---|---|---|---|
| WO | WO 02/056965 | A1 | 7/2002 |
| WO | WO 03/095031 | A1 | 11/2003 |

OTHER PUBLICATIONS

Brochure for Protector Vision 2 Negative Pressure Full Face Respirator, commercially available prior to Mar. 31, 2006.

A picture of MSA Advantage 3000 from Mine Safety Appliances Company of Pittsburgh, PA, commercially available prior to Mar. 31, 2006.

A picture of Scott AV 200 from Scott Health Safety of Monroe, NC, commercially available prior to Mar. 31, 2006.

A picture of Sundstrom SR 200 from Sundstrom Safety AB of Liddingo, Sweden, commercially available prior to Mar. 31, 2006.

A picture of ISI from ISI of Lawrenceville, GA, commercially available prior to Mar. 31, 2006.

A picture of 3M 7800 from 3M Corporation of St. Paul, MN, commercially available prior to Mar. 31, 2006.

A picture of 3M 6800 from 3M Corporation of St. Paul, Minnesota, commercially available prior to Mar. 31, 2006.

A picture of Draeger Panorama Nova from Draeger Safety Inc. of Pittsburgh, PA, commercially available prior to Mar. 31, 2006.

A picture of MSA Ultra Twin from Mine Safety Appliances of Pittsburgh, PA, commercially available prior to Mar. 31, 2006.

A picture of North 7600 Series Full Face Respirator from North Safety of Cranston, RI, commercially available prior to Mar. 31, 2006.

RESPIRATORY PROTECTION DEVICE

CROSS REFERENCE TO RELATED APPLICATION

This application is a continuation of U.S. Ser. No. 11/278,265, filed Mar. 31, 2006, now U.S. Pat. No. 7,594,510 now allowed, the disclosure of which is incorporated by reference in its entirety herein.

BACKGROUND

Respiratory protection devices (also referred to as respirators) for providing a breathable air supply to a wearer are used in a variety of different applications. The respirators can be used during fires, military operations and hazardous industrial applications where the air supply may be contaminated. In addition to providing a clean air source to the nose and mouth for breathing, full-face respirators also protect the eyes and face from harmful or irritating gases and other substances. The devices can further include mounts for accepting detachable and replaceable filter elements or connectors to air supplies.

There are a number of specific types of respirators in common use. These respirators include a lens, a face seal for mounting the lens about the face of a wearer, and one or more ports for providing an air supply to the wearer's face. Ports are provided in the face seal attached to the lens or in the lens material itself. These ports add complexity and cost to processes for making the face seal and/or lens. Additionally, respirators can be configured for different modes depending on particular situations for use. However, configuring respirators for multiple situations can lead to design tradeoffs that make the respirators less than optimal.

SUMMARY OF THE INVENTION

In one aspect, the invention is a respiratory device that comprises a face seal and a unitary body that forms an interface with the face seal and includes a lens and a chassis. The chassis includes at least one port for fluidic connection.

In another aspect, the invention is a combination that comprises a face seal and a first unitary body adapted to interface with the face seal. The first unitary body includes a lens and a chassis. The chassis includes at least one port for fluidic connection. The combination also includes a second unitary body adapted to interface with the face seal and includes a lens and a chassis. The chassis includes at least one port for fluidic connection.

In another aspect, the invention is a method of operating a respiratory device that comprises providing a face seal and providing a unitary body that is adapted to form an interface with the face seal. The unitary body includes a lens and chassis. The chassis includes at least one port for fluidic connection.

This summary is not intended to describe each disclosing embodiment or every implementation of the concepts presented herein. The figures and the description that follows more particularly exemplify illustrative embodiments.

GLOSSARY

The terms set-forth below will have meaning as defined:

"ambient air" means air present in a given environment independent of any cleaning or air moving apparatus present in that environment.

"air supply" means a supply of air provided by a blower unit, compressed air source, tank or other device.

"clean air" means air that has been filtered or that otherwise has been made safe to breath or to be in contact with skin.

"chassis" means a support structure other than a face seal for components of a respiratory device.

"fluidic connection" means a connection where fluid can be exchanged therethrough.

"interface" means a surface forming a common boundary between adjacent components.

"lens" means a device made of a material that allows light to pass therethrough.

"non-integral" means made separately from each other.

"opaque" means impenetrable by light.

"transparent" means permeable to light so that objects or images can be seen.

"unitary" means two or more parts joined together.

BRIEF DESCRIPTION OF THE DRAWINGS

The concepts presented herein will be further explained with reference to the attached figures, wherein like structure or system elements can be referred to by like reference numerals throughout the several views.

While the above-identified figures set forth one or more embodiments of the present invention, other embodiments are also contemplated, as noted herein. In all cases, concepts presented herein describe the invention by way of representation and not by limitation. It should be understood that numerous other modifications and embodiments can be devised by those skilled in the art which fall within the scope and spirit of the principles of this invention.

DETAILED DESCRIPTION OF THE PREFERRED EMBODIMENTS

Figure 1:
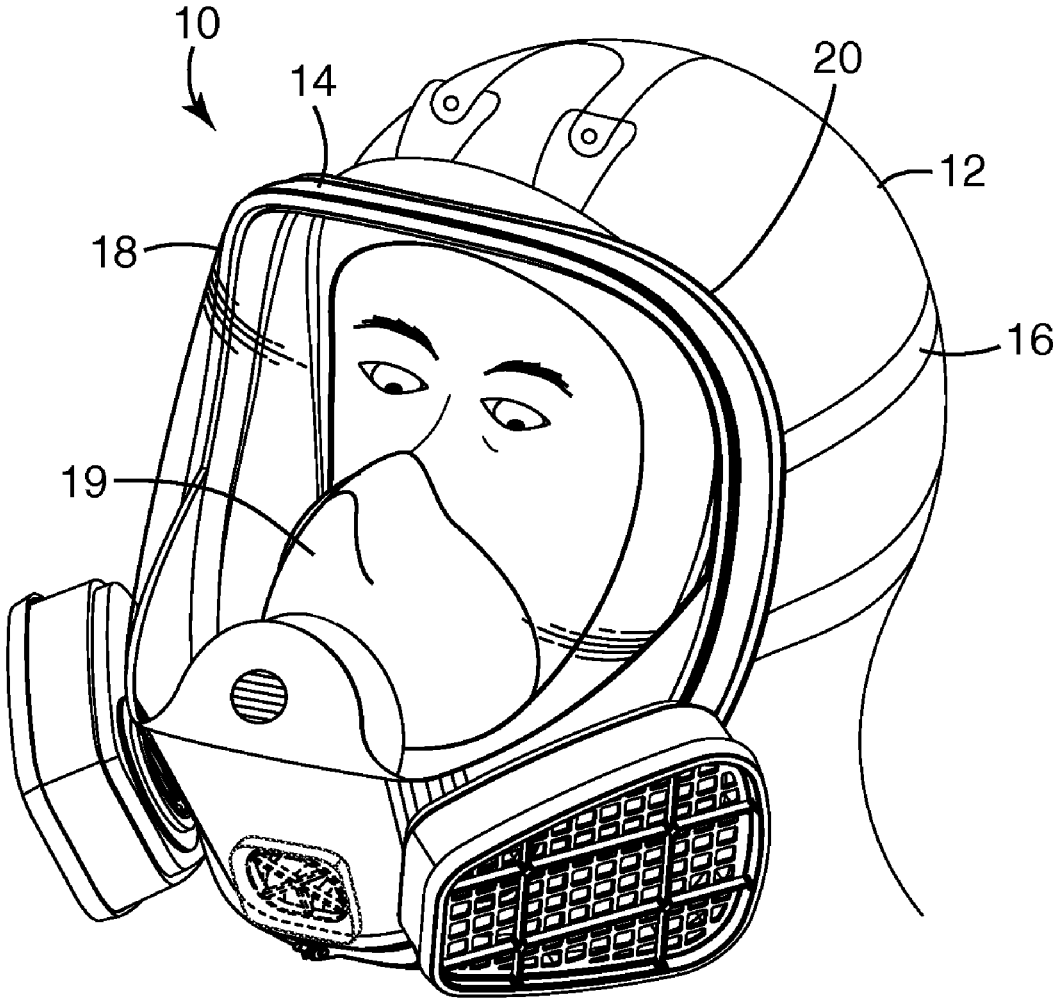
FIG. 1 is an isometric view of a respiratory protection device being worn by a wearer.

FIG. 1 is an isometric view of a respiratory protection device 10 being worn by a wearer 12. The device 10 includes a face seal 14 having a harness 16 for securing device 10 to a head of the wearer 12. A unitary body 18 forms an interface with face seal 14 to prevent air and other contaminants from reaching a face of the wearer 12. A nose cup 19 is coupled to unitary body 18 and surrounds a nose and mouth of wearer 12. A frame 20 is provided to clamp unitary body 18 to face seal 14. During operation, device 10 protects wearer from harmful gases, vapors and/or particulate matter. At least one port is provided in unitary body 18 to provide a connection for an air inlet and/or outlet. In some instances, a separate inhalation port and a separate exhalation port are employed.

Figure 2:
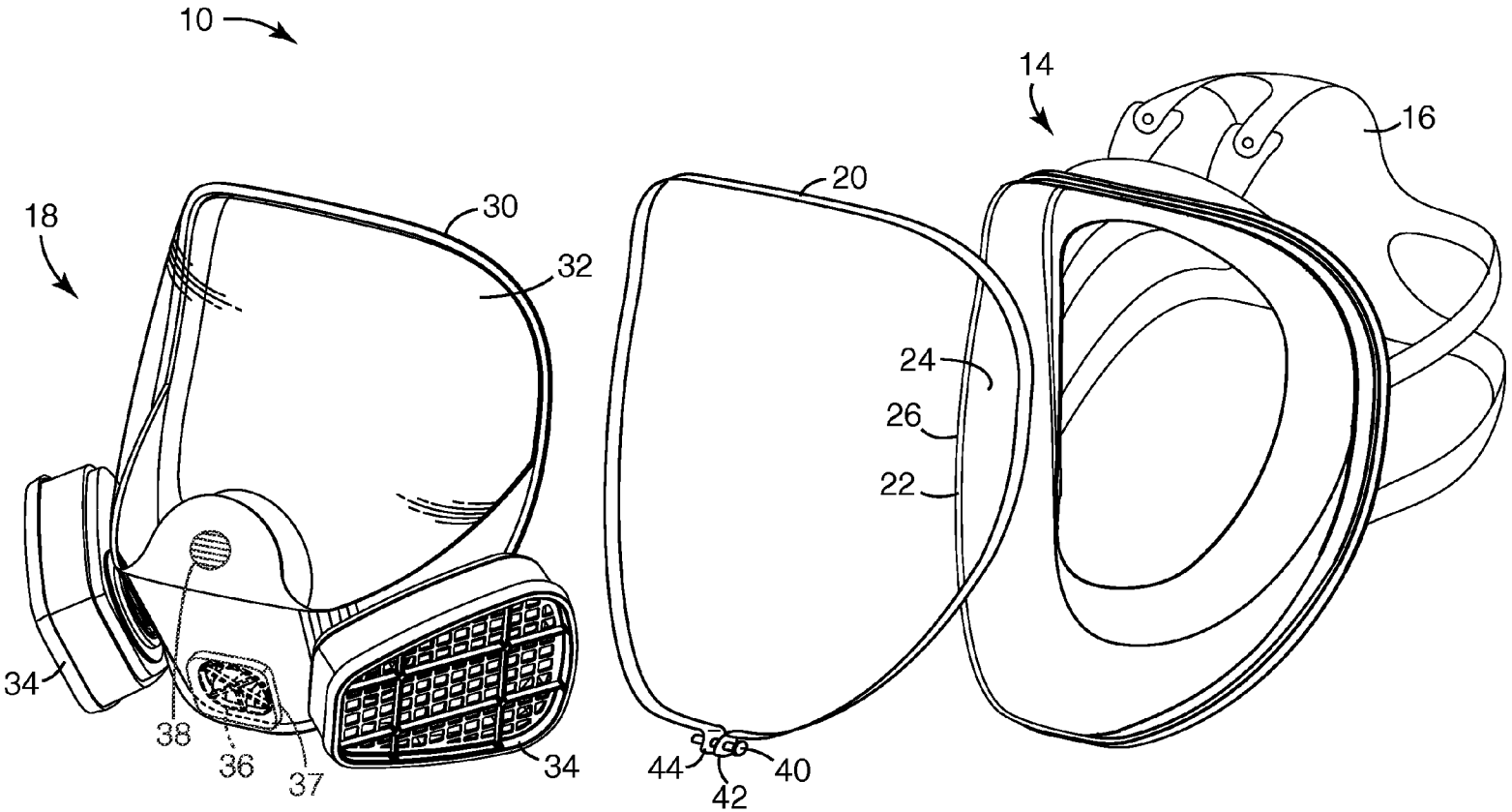
FIG. 2 is an exploded isometric view of a respiratory protection device.

FIG. 2 is an exploded isometric view of device 10. Face seal 14 is designed to provide a fluid-tight seal with the face of the wearer as well as interface with various unitary body constructions such as unitary body 18. In order to form an interface with unitary body 18, face seal 14 includes an annular ring 22. Annular ring 22 can be made of an elastomeric rubber such as silicone rubber and sized to surround a face of a wearer so as to not significantly inhibit a field of view of the wearer. Unitary body 18 forms an interface with an inner surface 24 of annular ring 22. Frame 20 surrounds an outer surface 26 of annular ring 22 to provide a clamp to seal inner surface 24 against unitary body 18.

Since the face seal 14 is operable with various unitary body constructions, wearer 12 can choose to operate device 10 with an appropriate unitary body for a particular situation. As discussed below, the unitary body can support and carry various functional components for device 10. For example, a wearer can choose a particular unitary body that includes a speaking port and/or connection to a powered air supply depending on a situation in which device 10 is used. Thus, wearer 12 need not have a separate face seal 14 for each situation, which can reduce the cost of having multiple suitable respiratory protection devices for various applications. Since only a single common face seal needs to be used, a wearer can find a particular face seal that fits well on his/her head. Once this face seal has been found, the wearer can use the chosen face seal size and be confident that the face seal provides a proper fit. Additionally, since face seal 14 need not include functional components such as ports for fluidic connection, the amount of material used for face seal 14 and complexity of construction of face seal 14 is reduced.

Unitary body 18 can be optimized for a particular mode of operation. Different modes can be chosen depending on the hazardous situation in which device 10 is utilized. This choice can depend on the particular contaminants and levels of concentration of the contaminants for the situation. High levels of contaminants can require the use of a Powered Air Purifying Respirator (PAPR) or a supplied air respirator. The number, size and placement of components and/or features in a unitary body for the particular mode can be optimized. As a result, each unitary body can include a simple design that meets the needs for the particular mode. Thus, device 10 provides simplicity of use (since no extraneous parts are present, which avoids confusion over the purpose and need of the extraneous parts), ease of training and ease of maintenance. Furthermore, protection, comfort and experience of the user can be enhanced.

Unitary body 18 includes a chassis 30 and a lens 32 non-integral with chassis 30. Chassis 30 forms a support structure for functional components in respiratory device 10. These functional components can include one or more lenses, breathing components, speaking components, sensors, etc. In the embodiment illustrated, chassis 30 supports lens 32, side cartridges 34, an exhaust port 36 and a speaking port 38.

Chassis 30 can be formed from a thermoplastic material that is resistant to high temperatures and chemical agents. For example, chassis 30 can be formed of an engineering-grade thermoplastic such as nylon, Xenoy® resin and/or combinations thereof. Xenoy® resin is a blend of semi-crystalline polyester (which can for example be polybutylene terephthalate (PBT) or polyethylene terephthalate (PET)) and polycarbonate. Xenoy® resin is available from GE Plastics of Pittsfield, Mass. If desired, chassis 30 can be opaque to prevent passage of light therethrough. The chassis may include other physical properties as desired, such as being resistant to abrasives, impact and/or welding spatter, for example.

Lens 32 can be formed of a transparent engineering-grade thermoplastic such as polycarbonate and affixed to chassis 30. Thus, chassis 30 and lens 32 can be formed of different materials. Lens 32 can be bonded to chassis 30 to form an integral construction. For example, lens 32 can be chemically, mechanically or thermally bonded to chassis 30. Lens 32 can be molded or otherwise formed and affixed to chassis 30 using a molding or welding process, for example. In any event, a fluid-tight seal is formed between chassis 30 and lens 32.

Additionally, lens 32 can be transparent and can be treated with a coating to increase resistance to chemicals and/or scratching. For different applications, lens 32 can be of various types, for example tinted, clear, polarized, auto darkening, etc. It is also worth noting that since chassis 30 includes functional components of device 10, lens need not include these components, which can reduce the amount of material used for lens 32 and the complexity of lens 32. Thus, the design of lens 32 can concentrate on optical characteristics that are important for the viewing area without compromising these characteristics due to the complexity needed in supporting other components.

Side cartridges 34 can include suitable air treatment media such that a wearer will breathe ambient air from outside device 10, which is then filtered by the air treatment media or otherwise be made safe to breath and/or be in contact with skin. Cartridges 34 can be removable to allow other cartridges to be attached to chassis 30. Once wearer 12 breathes the clean air, the air can be exhausted through exhaust port 36. A valve cover 37 is provided to cover port 36 to prevent unwanted entry of contaminants through port 36. Speaking port 38 can amplify or otherwise transmit sound from the wearer outside of device 10.

To seal unitary body 18 to face seal 14, unitary body 18 is placed into contact with inner edge 24 of annular ring 22. Unitary body 18 can include a channel having a rib to provide a more secure seal for the interface between face seal 14 and unitary body 18. Frame 20, which can be a locking band or collar, is then positioned around outer edge 26 of annular ring 22. Frame 20 is just one example of a mechanism that can be used to clamp face seal 14 to unitary body 18. Other suitable mechanisms can also be employed.

In the embodiment illustrated, a fastener 40 can be used to provide a clamping force around outer surface 26 such that a sealed interface is formed between face seal 14 and unitary body 18. Frame 20 includes a first aperture 42 and a second aperture 44 to receive fastener 40. Second aperture 44 can be threaded to mate with threads on fastener 40. In order to utilize an alternative unitary body, fastener 40 can be loosened and unitary body 18 separated from face seal 14. The alternative unitary body can then be placed into contact with inner surface 24 and clamped using frame 20.

FIGS. 3-6 illustrate alternative unitary bodies that are adapted to form an interface with face seal 14. One or more of these unitary bodies can be provided with face seal 14 and/or frame 20 such that a particular unitary body can be chosen depending upon a particular application. Thus, a wearer can interchange different unitary bodies and only incur the expense of having a single face seal 14. Other advantages are also realized based on the discussion above.

Figure 3:
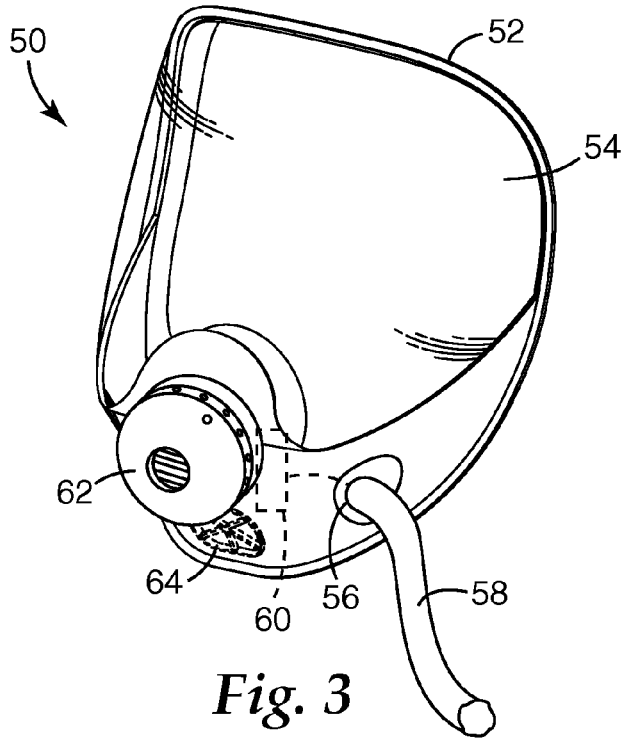
FIG. 3 is an isometric view of a unitary body.

FIG. 3 is an isometric view of a unitary body 50 having a chassis 52 and lens 54. Lens 54 is affixed to chassis 52 as discussed above. Chassis 52 includes an electrical connection 56 for a power cord 58. Power cord 58 is attached to a battery pack (not shown) and provides electrical current to a face mounted blower unit 60 embedded within chassis 52. A filter 62 can be provided such that blower unit 60 draws ambient air through filter 62 and blows clean air into the wearer's breathing zone. Unitary body 50 is useful when high levels of contaminants are present in a situation. Exhaust port 64 is provided to allow air to be exhausted by a wearer. A valve cover (not shown) can be used to cover port 64 as discussed above.

Figure 4:
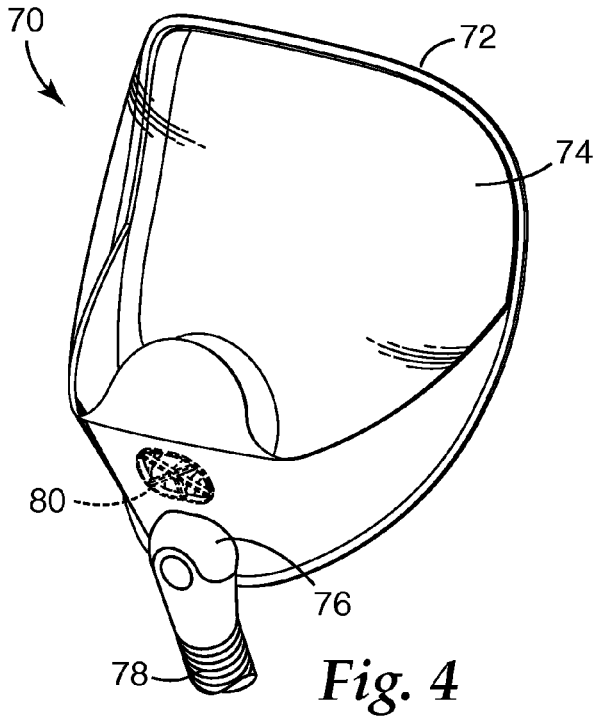
FIG. 4 is an isometric view of a unitary body.

FIG. 4 is an isometric view of unitary body 70 including a chassis 72 and lens 74. Lens 74 is affixed to chassis 72. Chassis 72 further includes a port 76 coupled to a hose 78 for delivering pressurized or powered air from a blower unit or compressed air supply. An exhaust port 80 is further provided to allow air to be exhausted by a wearer, which can be covered by a valve cover as discussed above.

Figure 5:
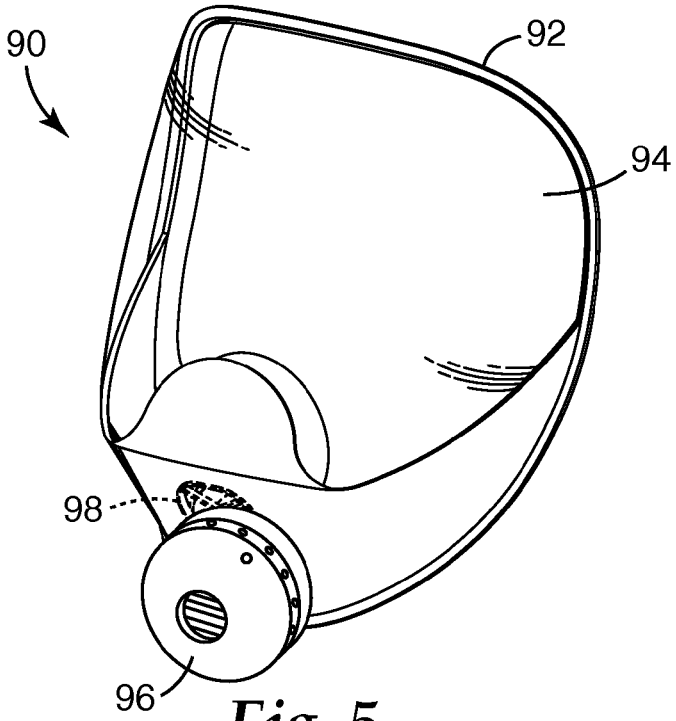
FIG. 5 is an isometric view of a unitary body.

FIG. 5 is an isometric view of a unitary body 90 having a chassis 92 and a lens 94 affixed thereto. Chassis 92 includes a port that is coupled to a central filter 96. A wearer's breathing forces air through filter 96. Exhaust port 98 allows air to be exhausted by a wearer. A value cover can also be used to cover port 98.

Additionally, lenses 32, 54, 74 and 94 are all similar in shape and size. Thus, although respective chassis for these lenses include different functional components of a respiratory device, a similar lens can be used for different chassis to reduce manufacturing costs.

Figure 6:
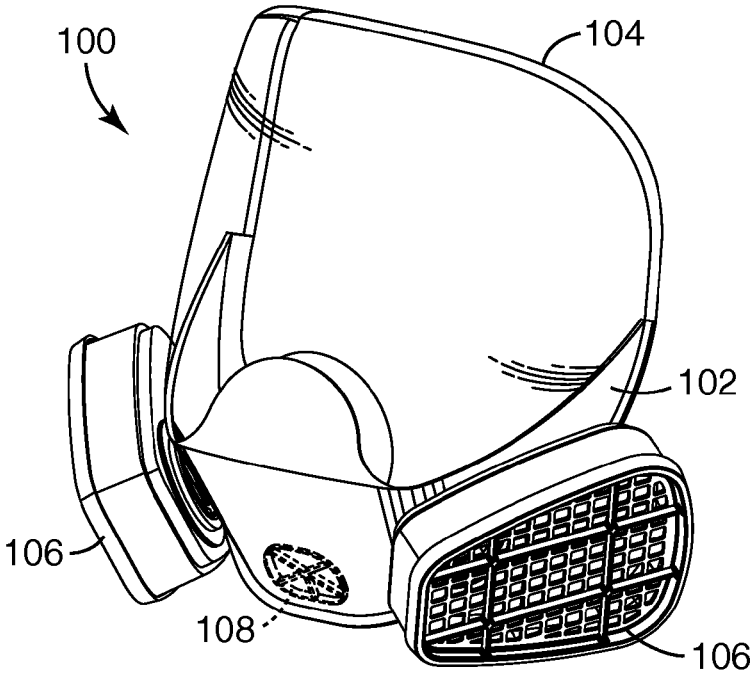
FIG. 6 is an isometric view of a unitary body.

FIG. 6 is an isometric view of another unitary body 100. Unitary body 100 includes a chassis 102 and a lens 104 affixed thereto. Similar to chassis 30, chassis 102 includes side cartridges 106 and exhaust port 108. Port 108 can also be covered by a valve cover. In this embodiment, lens 104 extends to an outer edge of unitary body 100 such that both lens 104 and chassis 102 form an interface with face seal 14.

By utilizing a common face seal such as face seal 14, various unitary body constructions can be used to operate a respiratory protection device. Thus, a combination of a face seal with more than one unitary body can provide a wearer with various options when encountering a hazardous respiratory situation. Using a frame such as frame 20, a wearer can easily separate one unitary body from a face seal and seal a second unitary body thereto.

Although the present invention has been described with reference to several alternative embodiments, workers skilled in the art will recognize that changes may be made in form and detail without departing from the spirit and the scope of the invention. For instance, any particular unitary body construction can be used in combination with a face seal. Furthermore, various components and configurations of ports and connections within a unitary body can be used. Moreover, features shown and described with respect to one embodiment may be combined with features of other embodiments, as desired.

What is claimed is:

1. A respiratory protection device that comprises:

(a) a lens;

(b) a chassis that surrounds a portion of the lens;

(c) a face seal that includes an annular ring that has a surface that forms an interface with the chassis; and (d) a frame that surrounds an outer surface of the annular ring and that enables the face seal to be clamped to the chassis and that allows the lens and the chassis to be removed from the face seal.

2. The respiratory protection device of claim 1, further comprising a fastener that assists in enabling the face seal to be clamped to the chassis and that can allow for removal of the lens and the chassis.

3. The respiratory protection device of claim 1 wherein the lens is formed of a first material and the chassis is formed of a second material that is different from the first material.

4. The respiratory protection device of claim 1 wherein the lens is transparent and the chassis is opaque.

5. The respiratory protection device of claim 1 and further comprising:

air treatment media operably coupled to the at least one port.

6. The respiratory protection device of claim 1 wherein the chassis further includes a speaking port.

7. The respiratory protection device of claim 1 wherein at least one of the chassis and the lens forms an interface with the face seal.

8. A combination that comprises the respiratory protection device of claim 1, and that further comprises:

a second lens and a second chassis, the second chassis being adapted to interface with the face seal.

9. The combination of claim 8 wherein the second lens is made from a first material and the second chassis is made from a second material that is different from the first material.

10. The respiratory protection device of claim 1, wherein the chassis is non-integral to the lens and includes at least one port for fluidic connection.

11. The respiratory protection device of claim 10, wherein the lens and chassis can be removed from the face seal so that a second lens can be installed such that the face seal is clamped to the chassis.

12. The respiratory protection device of claim 1, wherein the lens and the chassis are bonded together.

13. The respiratory protection device of claim 1, wherein the lens and chassis are molded together.

14. The respiratory protection device of claim 1, wherein the lens and chassis form an integral construction.

* * * * *